US008897679B2

(12) United States Patent
Kawashima

(10) Patent No.: US 8,897,679 B2
(45) Date of Patent: Nov. 25, 2014

(54) IMAGE FORMING APPARATUS

(71) Applicant: Kyocera Document Solutions Inc., Osaka (JP)

(72) Inventor: Tetsuro Kawashima, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 128 days.

(21) Appl. No.: 13/686,431

(22) Filed: Nov. 27, 2012

(65) Prior Publication Data

US 2013/0136504 A1 May 30, 2013

(30) Foreign Application Priority Data

Nov. 28, 2011 (JP) ..... 2011-258678

(51) Int. Cl.
*G03G 15/08* (2006.01)
*G03G 21/16* (2006.01)

(52) U.S. Cl.
CPC ..... *G03G 15/0879* (2013.01); *G03G 21/1676* (2013.01)
USPC ..... 399/258; 399/111; 399/120; 399/255

(58) Field of Classification Search
USPC ..... 399/111, 120, 255, 258
See application file for complete search history.

(56) References Cited

U.S. PATENT DOCUMENTS

2007/0077097 A1 * 4/2007 Watanabe et al. ..... 399/258

FOREIGN PATENT DOCUMENTS

JP 2009-204772 9/2009
JP 2010-243958 10/2010

* cited by examiner

*Primary Examiner* — Walter L Lindsay, Jr.
*Assistant Examiner* — Roy Y Yi
(74) *Attorney, Agent, or Firm* — K&L Gates LLP

(57) ABSTRACT

An image forming apparatus includes a main body, a developing device, a support frame, a developer case, and an intermediate hopper. The support frame selectively positions the developing device to a detachment position and a developing position. The intermediate hopper includes a first hopper, a second hopper, and a third hopper. The first hopper receives developer from the developer case through a developer inlet port. The second hopper has a developer outlet port, through which the developer is supplied to the developing device. The upper and lower end portions of the third hopper are respectively connected to the first and second hoppers. Parts where the first to third hoppers are connected one another are rotatable in directions that allow the support frame to move.

12 Claims, 14 Drawing Sheets

IMAGE FORMING APPARATUS

INCORPORATION BY REFERENCE

This application is based upon, and claims the benefit of priority from, corresponding Japanese Patent Application No. 2011-258678 filed Nov. 28, 2011, the entire contents of which is incorporated herein by reference.

BACKGROUND

The present disclosure relates to image forming apparatuses such as copiers, facsimile machines, and printers, which are equipped with a detachable developing device.

For ease of maintenance, a toner container for containing toner (developer), is integrated with a developing device used for an image forming apparatus so as to form a single unit. When the developing device runs out of developer, the whole integrated unit is replaced. However, from an economical viewpoint, the frequent replacement of the developing device is not desirable. Thus, in order to form images on many sheets using developer contained in a single developing device, the amount of developer contained in the developing device needs to be increased. However, with the above-described method, the size of the unit increases as the amount of developer contained in the unit is increased. In order to reduce the size of the developing device, image forming apparatuses wherein the developer is supplied from a toner container separated from the developing device, have been proposed.

With the above-described image forming apparatuses, it is desirable that the toner container or the developing device be separately detachable from the image forming apparatuses for ease of maintenance and replacement of the toner container or the developing device. However, in the situation where the toner container and the developing device are directly connected to each other, the order of attachment and detachment of the toner container and the developing device is restricted depending on the positional relationship of the toner container and the developing device, thereby reducing operability. Furthermore, due to restrictions on the internal layout of the image forming apparatuses, the toner container and the developing device cannot be located adjacent to each other.

In order to avoid the above-described problems, it is known to provide the intermediate hopper between the developer case, such as a toner container, and the developing device. For example, a known image forming apparatus includes a toner transportation device between the toner bottle and the developing device. The toner transportation device has a toner tank unit and a toner transportation pipe. It is also known to provide a service hopper between the toner bottle and the developing device.

With such image forming apparatuses, the developing device or the developer case is separately detachable while leaving the intermediate hopper on the main body side of the image forming apparatus. Furthermore, since the size of the developer case and the developing device can be reduced to a minimum size, the size of the image forming apparatuses can be reduced and the space necessary for the image forming apparatuses can be reduced.

In order to avoid interference of the developing roller (developer carrying body) with the photoconductor drum (image carrying body) when the developing device is attached to or detached from the image forming apparatus main body, the developing device needs to be moved to a position where the developing roller is separated from the photoconductor drum by a specified distance during detachment or attachment of the developing device.

However, as is the case with the above-described image forming apparatuses, when the connection portion of the intermediate hopper, the connection portion being connected to a developer receiving port of the developing device, is secured to the main body side of the image forming apparatus, the positional relationship of the connection portion of the intermediate hopper and the developer receiving port of the developing device may change due to a movement of the developing device. This causes the developer to leak through the connection portion where the developing device and the intermediate hopper are connected to each other.

It is also possible to have a structure in which the intermediate hopper is movable together with the developing device. However, with such a structure: the size of a movement mechanism is increased; a space that allows the intermediate hopper and the developing device to move therethrough is needed; and the positional relationship between the intermediate hopper and the developer case changes. Accordingly, a larger movement structure and greater space are required for the intermediate hopper and the developing device to move together with the developer case in order to prevent a defective connection of the intermediate hopper to the developer case from occurring.

SUMMARY

An image forming apparatus according to an embodiment of the present disclosure is provided that includes a main body, a developing device, a support frame, a developer case, and an intermediate hopper. The developing device is positioned opposite an image carrying body, on which an electrostatic latent image is formed, and includes a developer carrying body that supplies a developer to the image carrying body in an area where the developer carrying body opposes the image carrying body. The support frame is reciprocable so as to selectively position the developing device at a detachment position, at which the developer carrying body is separated from the image carrying body, and a developing position, at which the developer is supplied to the image carrying body. The developer case is located at an upper position relative to the developing device and contains the developer to be supplied to the developing device. The intermediate hopper is positioned between the developer case and the developing device. The intermediate hopper includes a first hopper, a second hopper, and a third hopper. The first hopper has a developer inlet port, through which the developer discharged through a developer discharge port of the developer case is received, and is located in the main body such that the developer inlet port opposes the developer discharge port. The second hopper has a developer outlet port. The developer is supplied to the developing device through the developer outlet port and a developer receiving port. The second hopper is located on the support frame such that the developer outlet port opposes the developer receiving port. Upper and lower end portions of the third hopper are respectively connected to the first and the second hoppers. A part where the third hopper and the first hopper are connected to each other and a part where the third hopper and the second hopper are connected to each other are rotatable in directions that allow the support frame to move.

Additional features and advantages are described herein, and will be apparent from the following Detailed Description and the figures.

DETAILED DESCRIPTION

Figure 1:
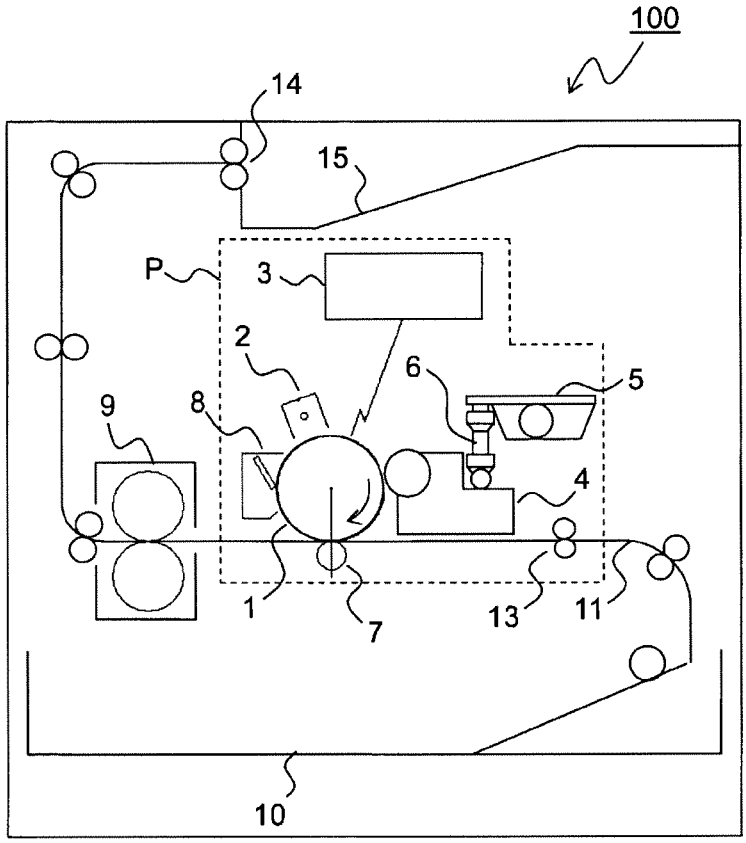
FIG. 1 is a schematic sectional view of an image forming apparatus according to one embodiment of the present disclosure.

An embodiment of the present disclosure will be described below with reference to the drawings. FIG. 1 is a schematic sectional view of an image forming apparatus according to an embodiment of the present disclosure. A copying operation is performed with an image forming apparatus (for example, a monochrome printer) 100 as follows: in an image forming section P provided in a main body, an electrostatic latent image is formed in accordance with original image data transmitted from a personal computer (PC, not shown), and a developing device 4 causes the toner to adhere to the electrostatic latent image so as to form a toner image. The toner is supplied to the developing device 4 from a toner container 5 (developer case) through an intermediate hopper 6. In the image forming apparatus 100 as described above, an image is formed on a photoconductor drum 1 (image carrying body) is performed by rotating the photoconductor drum 1 clockwise in FIG. 1.

A charger 2, an exposure unit 3, the developing device 4, a transfer roller 7, a cleaning device 8, and an eraser (not shown) are located in a direction in which the photoconductor drum 1 rotates (clockwise) in the image forming section P. The photoconductor drum 1 uses, for example, an aluminum drum with a photo-sensitive layer formed on the aluminum drum. A surface of the photoconductor drum 1 is charged by the charger 2. An electrostatic latent image, where charges are attenuated, is formed on the surface of the photoconductor drum 1 by receiving a laser beam from the exposure unit 3, which will be described later. Although the material of the above-described photo-sensitive layer is not particularly limited, it is desirable that the photo-sensitive layer be formed of, for example, amorphous silicon (a-Si), which has a good durability, or an organic photoconductor (OPC), with which the amount of ozone generated is small when the photoconductor drum 1 is charged, and high-resolution images can be obtained, or the like.

The charger 2 uniformly charges the surface of the photoconductor drum 1. The charger 2 uses, for example, a corona discharge device. The corona discharge device uses a thin wire or the like as an electrode, to which high voltage is applied so as to cause a discharge. Instead of the corona discharge device, a contacting charger may be used. In this case, voltage is applied while a charging member, typically a charging roller, is in contact with a surface of a photoconductor body. The exposure unit 3 emits a light beam (for example, a laser beam) toward the photoconductor drum 1 based on image data so as to form an electrostatic latent image on the surface of the photoconductor drum 1.

The developing device 4 forms a toner image by causing the toner to adhere to the electrostatic latent image formed on the photoconductor drum 1. Here, the developing device 4 contains a one-component developer (toner) including only a toner component having a magnetic property. The details of the developing device 4 will be described later. The transfer roller 7 transfers the toner image formed on the surface of the photoconductor drum 1 onto a sheet of paper being transported through a sheet transportation path 11 without distorting the toner image. The cleaning device 8 includes components such as a cleaning roller and a cleaning blade, which are in line contact with the photoconductor drum 1 in the longitudinal direction of the photoconductor drum 1. The cleaning device 8 removes residual toner remaining on the surface of the photoconductor drum 1 after the toner image has been transferred onto the sheet.

The exposure unit 3 emits the laser beam toward the photoconductor drum 1 based on the image data input thereto, thereby forming an electrostatic latent image according to the image data on the surface of the photoconductor drum 1. After that, the developing device 4 causes the toner to adhere to the electrostatic latent image so as to form a toner image.

The sheet is transported from a sheet loading unit 10 to the image forming section P, in which the toner image has been formed as described above, through the sheet transportation path 11 and a registration roller pair 13 at a specified timing. The toner image formed on the surface of the photoconductor drum 1 is transferred onto the sheet using the transfer roller 7 in the image forming section P. The sheet, onto which the toner image has been transferred, is removed from the photoconductor drum 1, transported to a fixing unit 9 so as to be heated and pressurized so that the toner image is fixed onto the sheet. The sheet having passed through the fixing unit 9 passes through a nip between a delivery roller pair 14 and delivered to a sheet delivery unit 15.

Figure 2:
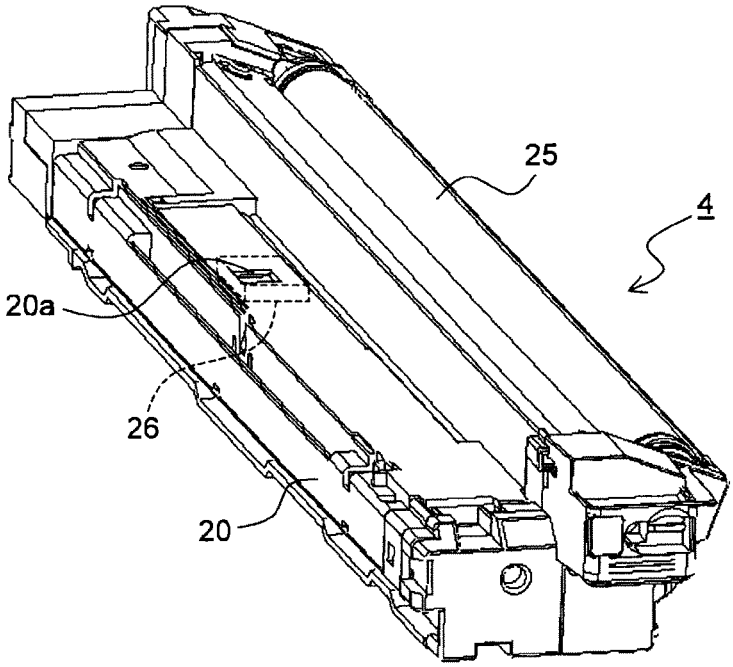
FIG. 2 is an external perspective view of a developing device attached to the image forming apparatus.
Figure 3:
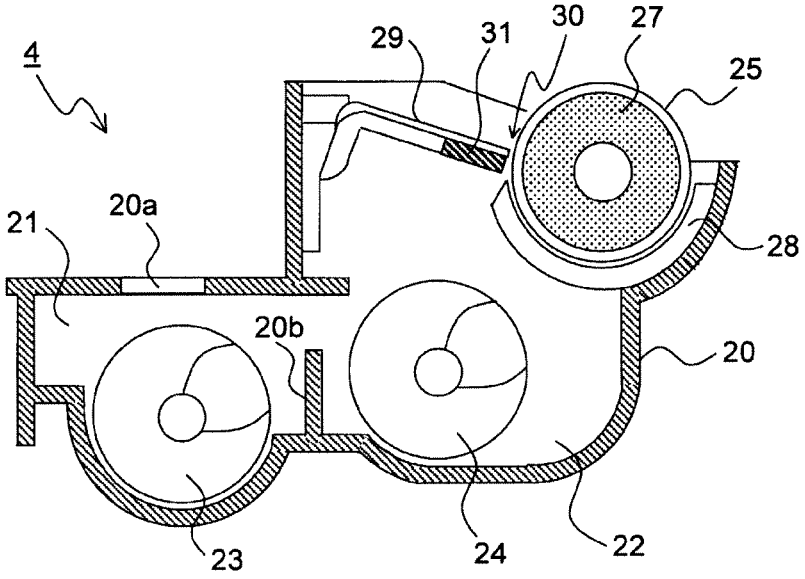
FIG. 3 is a side sectional view of the developing device illustrated in FIG. 2.

FIGS. 2 and 3 are respectively a perspective view and a side sectional view of the developing device 4. As illustrated in FIG. 3, a first storage chamber 21 and a second storage chamber 22 are defined by a partition wall 20*b* in a developing case 20. The partition wall 20*b* is integrally formed with the developing case 20. A first agitating screw 23 and a second agitating screw 24 are respectively provided in the first storage chamber 21 and the second storage chamber 22. A toner receiving port 20*a* is formed in an upper portion of the developing case 20. The toner stored in the toner container 5 (see FIG. 1) is supplied through the intermediate hopper 6 (see FIG. 1) based on a detection result from a toner sensor (not shown), which detects the amount of toner in the developing case 20.

A sponge member 26 surrounds an opening edge of the toner receiving port 20*a*. The sponge member 26 tightly seals a gap between the toner receiving port 20*a* and a toner outlet port 62 (developer outlet port, see FIG. 6) so as to prevent the toner from leaking through the gap. The toner outlet port 62 is formed in a second hopper portion 6*b* (second hopper) of the intermediate hopper 6.

The first agitating screw 23 and the second agitating screw 24 each have a support shaft at the center thereof and a spiral blade provided around the support shaft. The first agitating screw 23 and the second agitating screw 24 are rotatably supported in the developing case 20 so as to be parallel to each other. The partition wall 20*b* is omitted at both ends in the longitudinal direction of the developing case 20 (a direction perpendicular to the page of FIG. 3), which is axial directions of the first agitating screw 23 and the second agitating screw 24. By doing this, toner can be transported between the first agitating screw 23 and the second agitating screw 24. Thus, the first agitating screw 23 transports toner in the first storage chamber 21 to the second storage chamber 22 while agitating toner in the first storage chamber 21, and the second agitating screw 24 supplies toner having been transported to the second storage chamber 22 to a developing roller 25 (developer carrying body) while agitating toner having been transported.

The developing roller 25 is rotatably supported in the developing case 20 so as to be parallel to the first agitating screw 23 and the second agitating screw 24. A magnetic body 27, which includes permanent magnets and has a plurality of magnetic poles, is located in the developing roller 25. The magnetic force of the magnetic body 27 causes the toner to adhere to (to be carried by) a surface of the developing roller 25 so as to form a thin toner layer. Part of an outer peripheral surface of the developing roller 25 is exposed from the developing case 20 such that the exposed part opposes the photoconductor drum 1 (see FIG. 1).

The developing roller 25, on which the thin toner layer has been formed, rotates with the rotation of the photoconductor drum 1 (see FIG. 1), thereby supplying the toner to the photosensitive layer of the photoconductor drum 1. The first agitating screw 23, the second agitating screw 24, and the developing roller 25 are rotated at specified speeds by a motor (not shown) and a gear train. Magnetic seal members 28 are provided at both ends of the developing roller 25 so as to prevent the developer from leaking through gaps between the developing case 20 and the developing roller 25.

A regulating blade 29 having longitudinal dimension greater than a maximum developing width of the developing roller 25, is spaced apart from the developing roller 25 by a specified gap, thereby forming a layer thickness regulating portion 30 that regulates the amount of toner to be supplied to the photoconductor drum 1. The size of the gap of the layer thickness regulating portion 30 is set to about 0.2 mm to 0.4 mm. The regulating blade 29 is formed of a magnetic material or a non-magnetic material such as stainless steel. Here, a permanent magnet 31 is attached to the regulating blade 29 formed of a magnetic material so as to impart magnetic properties.

The magnetic body 27 has the plurality of magnetic poles (not shown) including the N- and the S-poles located parallel to the axial direction of the developing roller 25. Since the magnetic poles of the magnetic body 27 are parallel to the regulating blade 29, the poles are concentrated at an end of the regulating blade 29, thereby generating a magnetic field in attracting directions in the layer thickness regulating portion 30.

A toner chain (magnetic brush), which is a series of toner particles, is formed between the regulating blade 29 and the developing roller 25 by the magnetic field. Thus, when the developing roller 25 passes the layer thickness regulating portion 30, the thin toner layer is formed on the developing roller 25. Since the permanent magnet 31 is attached to the regulating blade 29, the regulating force is increased not only by the gap of the layer thickness regulating portion 30, but also by the magnetic field generated in the layer thickness regulating portion 30. This thereby forms the thin toner layer having a thickness of several tens of μm on the developing roller 25. Part of the toner not used for formation of the thin toner layer accumulates along a side surface of the regulating blade 29, the side surface being located on the upstream side (lower side in FIG. 3) of the regulating blade 29. After that, when the toner chain is moved to a position opposite the photoconductor drum 1 due to rotation of the developing roller 25 clockwise in FIG. 3, the toner chain is brought into contact with the surface of the photoconductor drum 1 so as to form the toner image.

Figure 4:
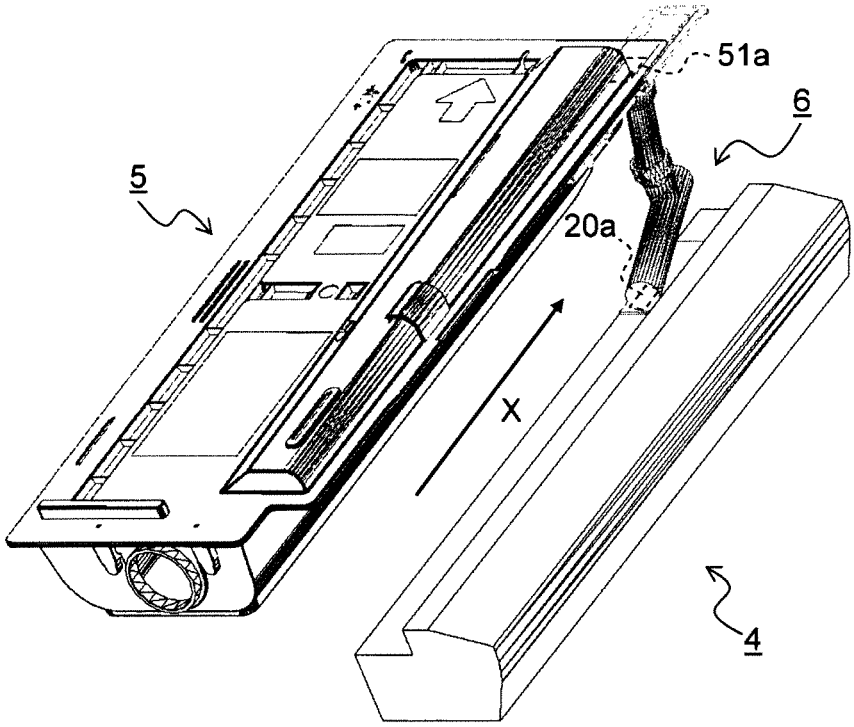
FIG. 4 is an external perspective view illustrating positional relationships among the developing device, a toner container, and an intermediate hopper when the developing device is positioned at a developing position.
Figure 5:
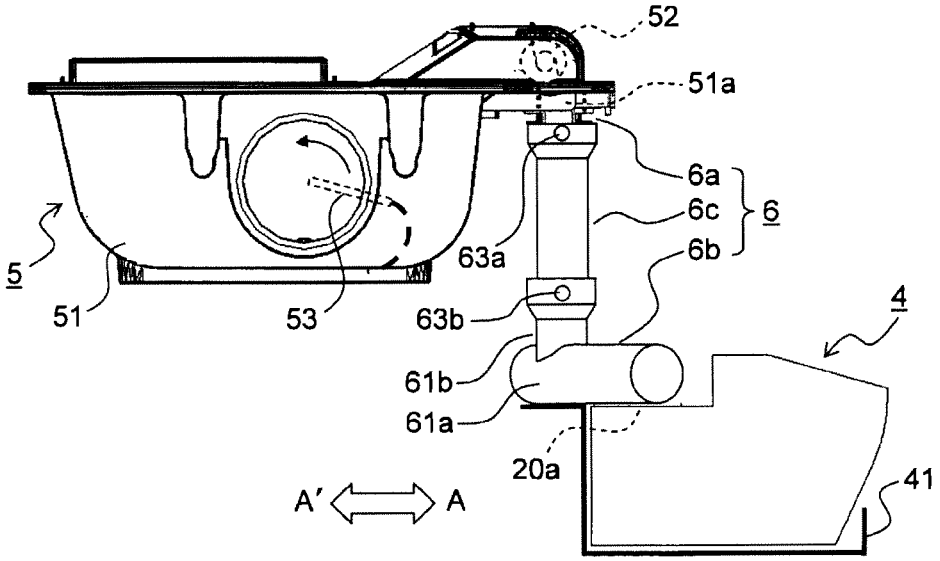
FIG. 5 is a side view illustrating positional relationships among the developing device, the toner container, and the intermediate hopper when the developing device is positioned at the developing position.
Figure 6:
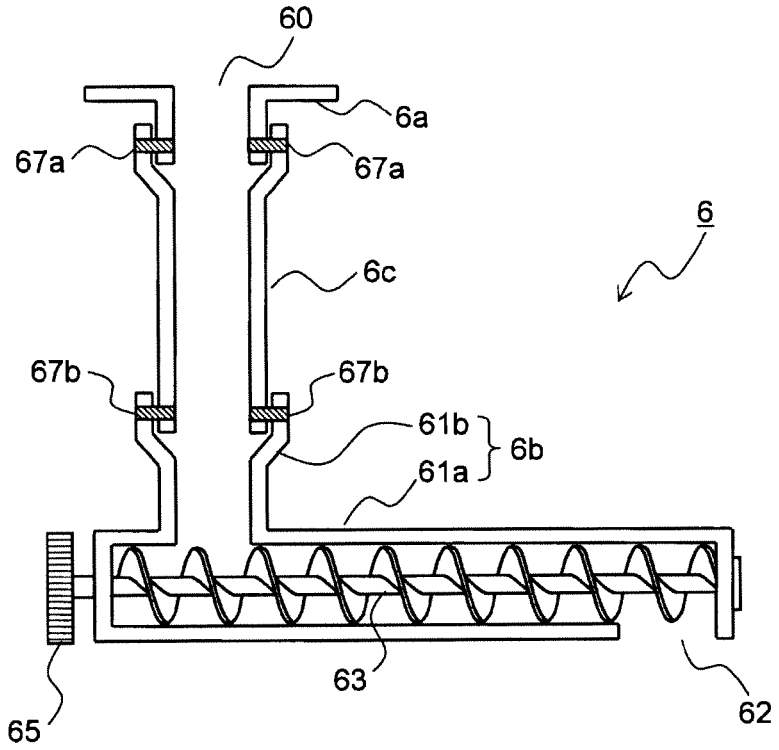
FIG. 6 is a side sectional view of an internal structure of the intermediate hopper.

FIG. 4 is an external perspective view of the developing device 4, the toner container 5, and the intermediate hopper 6 viewed from a diagonally upper direction. FIG. 5 is a side view illustrating the positional relationship in the image forming apparatus 100 illustrated in FIG. 1 of the developing device 4, the toner container 5, and the intermediate hopper 6 illustrating in FIG. 4. FIG. 6 is a side sectional view of the internal structure of the intermediate hopper 6. FIG. 4 and FIG. 5 illustrates a rear side view of the page of FIG. 1, and accordingly, the left and right sides of the developing device 4 and the toner container 5 are inverted compared to those in FIG. 1. Also in FIG. 4, the support frame 41, which supports the developing device 4, is omitted.

The developing device 4 is attached to the support frame 41, which is movable relative to the main body of image forming apparatus 100 (see FIG. 1) in a horizontal direction (the directions indicated by arrows A and A'). When the support frame 41 is moved in the direction of arrow A, the developing device 4 is located at a position where the developing roller 25 (see FIG. 3) opposes the photoconductor drum 1 with a predetermined gap therebetween, and is allowed to supply toner to the photoconductor drum 1 (referred to as a developing position hereafter). When the support frame 41 is moved in the direction indicated by arrow A', the developing device 4 is located at a position where the developing roller 25 is separated from the photoconductor drum 1 and the developing device 4 is detachable from the main body of image forming apparatus 100 (referred to as a detachment position hereafter). In FIGS. 4 and 5, the developing device 4 is located at the developing position.

When the developing device 4 is located at the detachment position, by pushing or pulling the developing device 4 along a bottom surface of the support frame 41 in a direction perpendicular to the page of FIG. 5, the developing device 4 is attached to or removed (detached) from the support frame 41. When the developing device 4 is located at the developing position, toner can be supplied from the developing roller 25 to the photoconductor drum 1. A movement mechanism of the support frame 41 will be described later.

The toner container 5 includes a container case 51, which contains the toner, a transportation screw 52, and an agitating paddle 53. A toner discharge port 51*a*, to which a first hopper portion 6*a* (first hopper) of the intermediate hopper 6 is secured, is formed at one end in the longitudinal direction of the container case 51. The agitating paddle 53 has a film-shaped agitating blade that extends from a shaft portion thereof in a radial direction on one side of the axis along the container case 51 in the longitudinal direction. When the agitating paddle 53 rotates, the toner contained in the container case 51 is agitated. The agitated toner is transported toward the transportation screw 52 side.

The transportation screw 52 has a spiral blade having a spiral shape around a shaft portion thereof so that the turns of the spiral blade are separated from one another by a uniform phase (pitch) in the longitudinal direction of the transportation screw 52. The transportation screw 52 opposes the toner discharge port 51*a* of the container case 51. When the transportation screw 52 rotates, the toner agitated by the agitating paddle 53 is transported in a direction toward the toner discharge port 51*a* (the direction indicated by an arrow X in FIG. 4) due to advancement of the phase of the spiral blade, and supplied to the first hopper portion 6*a* through the toner discharge port 51*a* and a toner inlet port 60.

The intermediate hopper 6 includes the first hopper portion 6*a*, the second hopper portion 6*b*, and a third hopper portion 6*c* (third hopper). The first hopper portion 6*a* is located on the toner container 5 side, the second hopper portion 6*b* is located on the developing device 4 side, and the third hopper portion 6*c* connects the first hopper portion 6*a* to the second hopper portion 6*b*. The first-third hopper portions 6*a*-6*c* each have a stiff cylindrical body, and the internal portions of the first to third hopper portions 6*a*-6*c* communicate with one another.

The first hopper portion 6*a* is located in the main body of image forming apparatus 100 such that the toner inlet port 60 opposes the toner discharge port 51*a* of the toner container 5.

The second hopper portion 6*b* includes a transportation portion 61*a* and a connection portion 61*b*. The transportation portion 61*a* extends in the horizontal direction. The connection portion 61*b* protrudes upward from the transportation portion 61*a* in a direction substantially perpendicular to the transportation portion 61*a* and is connected to a lower end portion of the third hopper portion 6*c*. When the developing device 4 is attached to the support frame 41, the transportation portion 61*a* is positioned such that the toner outlet port 62 opposes the toner receiving port 20*a* of the developing device 4. Thus, the second hopper portion 6*b* is movable together with the support frame 41.

A spiral 63 (transportation member) is located in the transportation portion 61*a*. The spiral 63 transports the toner, which has passed through the first hopper portion 6*a*, the third hopper portion 6*c*, and the connection portion 61*b*, toward the toner outlet port 62. One end of a rotation shaft of the spiral 63 extends to the outside of the transportation portion 61*a*. A drive input gear 65, which transmits a drive force from a drive motor (not shown) to the spiral 63, is provided to the part of the rotation shaft located outside the transportation portion 61*a*.

An upper end portion of the third hopper portion 6*c* is rotatably connected to a lower end portion of the first hopper portion 6*a* with a pin 67*a*. The lower end portion of the third hopper portion 6*c* is rotatably connected to an upper end portion of the connection portion 61*b* of the second hopper portion 6*b* with a pin 67*b*.

With the above-described structure, when the support frame 41 reciprocates in the direction indicated by arrow A-A' (horizontal movement), the intermediate hopper 6 allows a connecting part where the first hopper portion 6*a* and the third hopper portion 6*c* are connected to each other, and a connecting part where the third hopper portion 6*c* and the second hopper portion 6*b* are connected to each other to be rotated in response to the movement of the support frame 41.

The upper end portion of the third hopper portion 6*c*, the upper end portion being connected to the first hopper portion 6*a*, has an inner diameter that is larger than an outer diameter of the lower end portion of the first hopper portion 6*a*. The lower end portion of the third hopper portion 6*c*, the lower end portion being connected to the connection portion 61*b* of the second hopper portion 6*b*, has an outer diameter that is less than an inner diameter of the upper end portion of the connection portion 61*b*.

That is, at the connecting part where the first hopper portion 6*a* and the third hopper portion 6*c* are connected to each other, the upper end portion of the third hopper portion 6*c* receives the lower end portion of the first hopper portion 6*a* from below; and at the connecting part where the second hopper portion 6*b* and the third hopper portion 6*c* are connected to each other, the connection portion 61*b* of the second hopper portion 6*b* receives the lower end portion of the third hopper portion 6*c* from below. Thus, toner is prevented from leaking through the connecting parts of the first to third hopper portions 6*a* to 6*c*.

Figure 7:
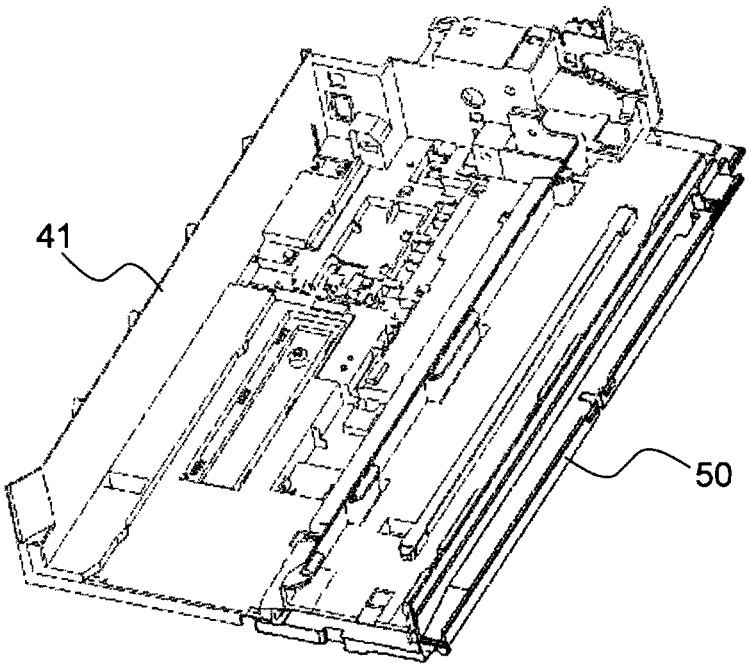
FIG. 7 is a perspective view illustrating when a support frame and a frame securing member located on the side of a main body of the image forming apparatus are connected to each other.
Figure 8:
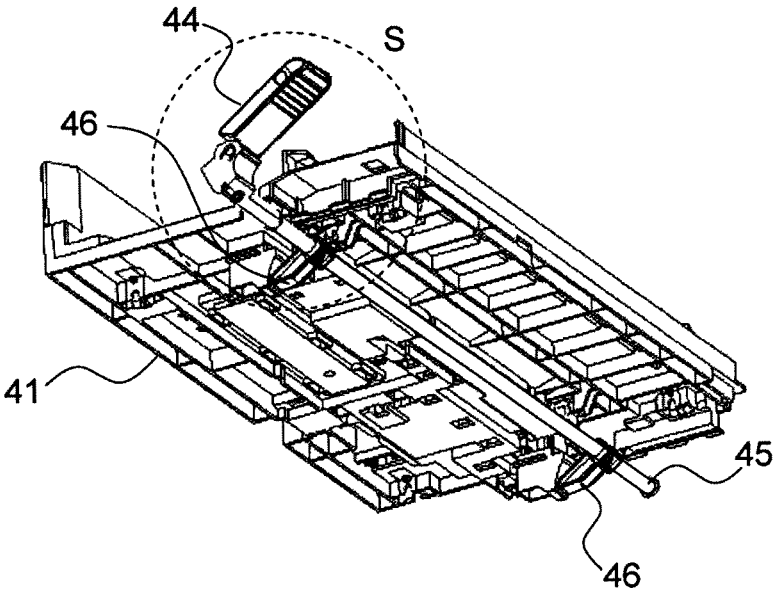
FIG. 8 is a perspective view of the support frame and a developing release lever seen from below.
Figure 9:
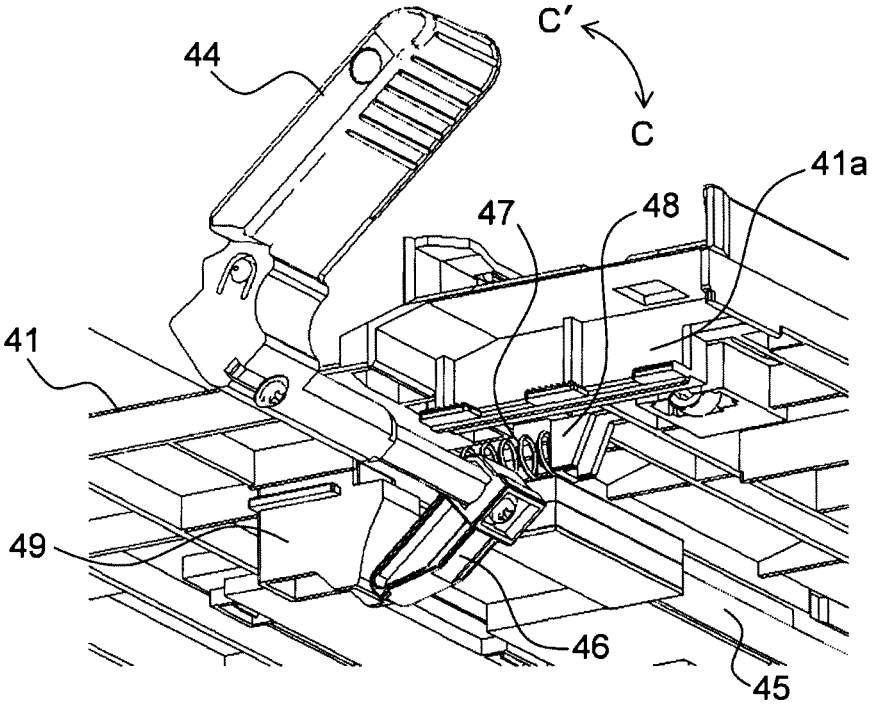
FIG. 9 is an enlarged view of a part around one of contact portions in FIG. 8.
Figure 10:
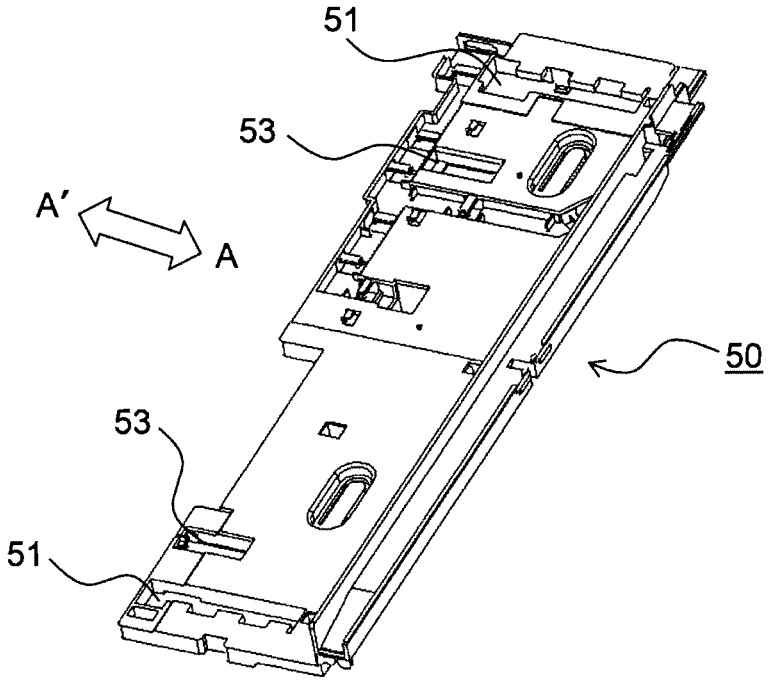
FIG. 10 is an elevational perspective view of the frame securing member seen from above.

Next, the movement mechanism of the support frame 41 will be described. FIG. 7 is a perspective view illustrating when the support frame 41 and a frame securing member 50 located on the main body of image forming apparatus 100 side are connected to each other. FIG. 8 is a perspective view of the support frame 41 and a developing release lever 44 as viewed from below. FIG. 9 is an enlarged view of a portion around one of contact portions 46 in FIG. 8 (in a dashed-circle S area in FIG. 8). FIG. 10 is a perspective view of the frame securing member 50 as viewed from above. In FIG. 7, the developing release lever 44 is omitted.

The developing release lever 44 is provided to one end of a shaft 45, which is rotatably supported on a lower side of the support frame 41. Two contact portions 46 are provided near both ends of the shaft 45. When the developing release lever 44 is operated, the shaft 45 and the contact portions 46 are rotated. A pair of rail units 41*a*, a pair of spring receiving units 48, and a pair of protruding portions 49 are formed on a lower surface side of the support frame 41. The spring receiving units 48 each receive one end of a corresponding one of coil springs 47, and the protruding portions 49 each oppose a corresponding one of the contact portions 46.

The frame securing member 50 is secured on the main body of image forming apparatus 100 side. Rail engagement grooves 51, with which the corresponding rail units 41*a* of the support frame 41 are engaged, and spring spaces 53, in which the corresponding coil springs 47 are contained, are formed in the frame securing member 50. That is, ends of each coil spring 47 are respectively in contact with the corresponding one of the spring receiving units 48 and an inner wall surface at a left end of the corresponding one of the spring spaces 53. Normally, an urging force acts on each spring receiving unit 48 of the support frame 41 in a direction in which the spring receiving unit 48 moves close to the frame securing member 50 (the direction indicated by arrow A).

When the developing release lever 44 is rotated in the direction indicated by arrow C as illustrated in FIG. 9, the shaft 45 and the contact portions 46 are also rotated in the same direction, and tips of the contact portions 46 press side surfaces of the protruding portions 49. This causes the support frame 41 to move in the direction indicated by arrow A', thereby positioning the developing device 4 (see FIG. 5) at the detachment position. Since the spring receiving units 48 are also moved in the direction indicated by arrow A' together with the movement of the support frame 41, the coil springs 47 are pressed against the inner wall surfaces at the left ends of the corresponding spring spaces 53 and compressed.

When the developing release lever 44 is rotated in the direction indicated by arrow C' so as to be returned to the position illustrated in FIG. 9, the shaft 45 and the contact portions 46 also rotate in the same direction, and the tips of the contact portions 46 are moved away from the side surfaces of the protruding portions 49. This causes the coil springs 47 that were compressed to return to their original length they were before compression by rotation of the developing release lever 44, and to press the corresponding spring receiving units 48, thereby moving the support frame 41 in the direction of arrow A and moving the developing device 4 (see FIG. 4) to the developing position.

Figure 11:
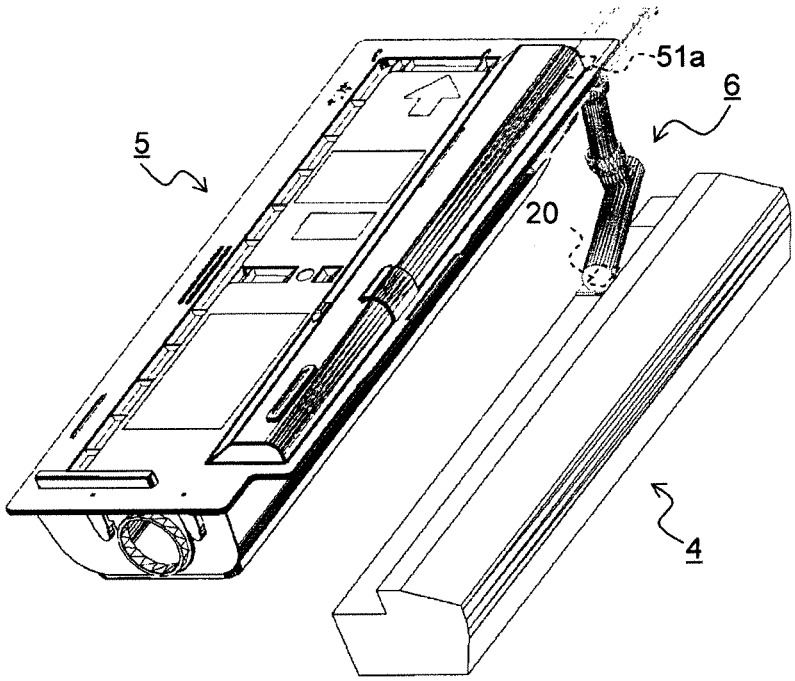
FIG. 11 is an external perspective view illustrating positional relationships among the developing device, the toner container, and the intermediate hopper when the developing device is positioned at a detachment position.
Figure 12:
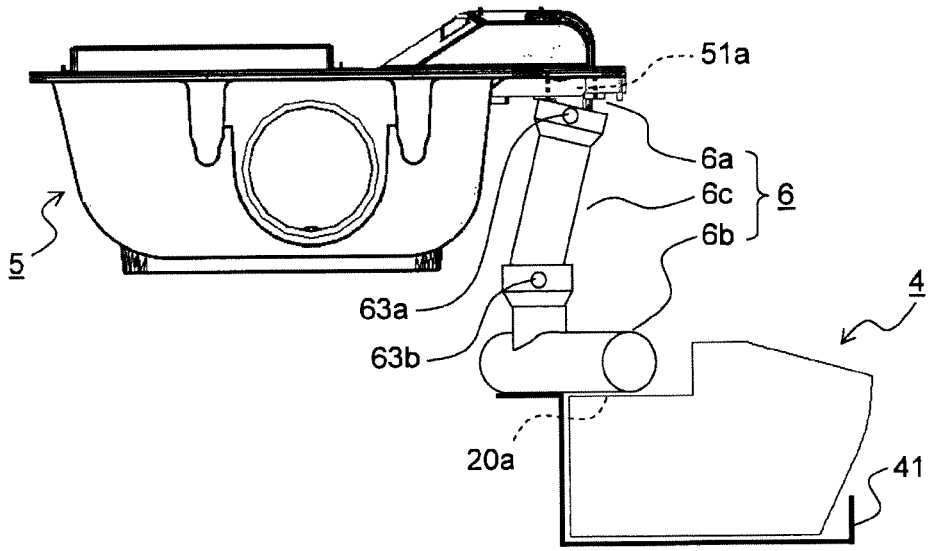
FIG. 12 is a side view illustrating positional relationships among the developing device, the toner container, and the intermediate hopper when the developing device is positioned at the detachment position.
Figure 13:
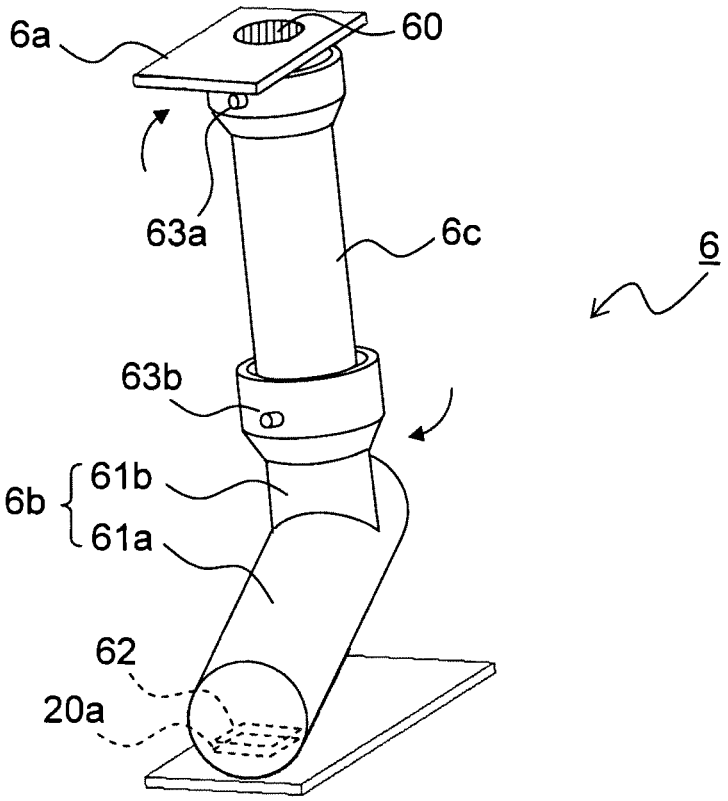
FIG. 13 is a perspective view illustrating the intermediate hopper when the developing device is positioned at the developing position.
Figure 14:
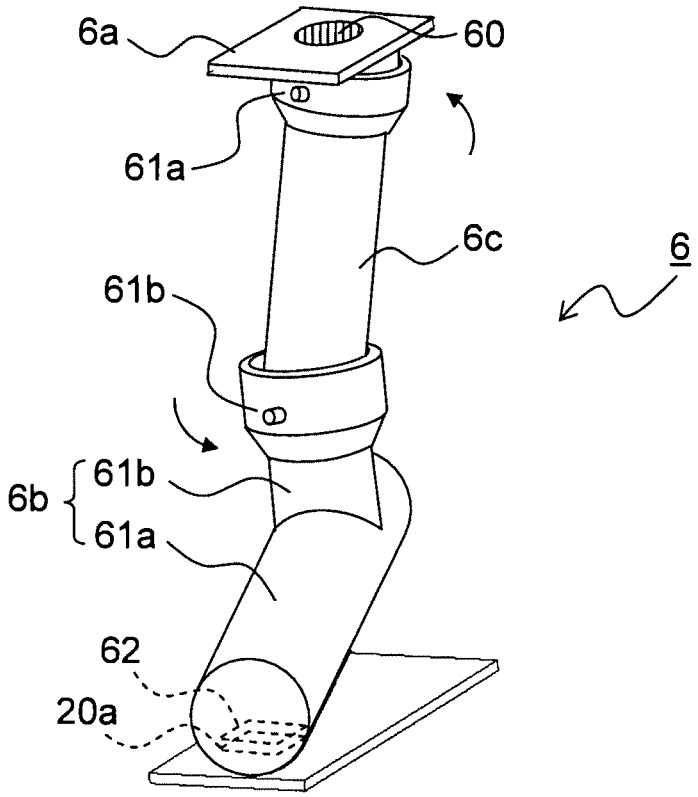
FIG. 14 is a perspective view illustrating the intermediate hopper when the developing device is positioned at the detachment position.

FIG. 11 is an external perspective view seen from the diagonally upper direction illustrating the developing device 4, the toner container 5, and the intermediate hopper 6 when the developing device 4 is located at the detachment position. FIG. 12 is a side view illustrating the positional relationships of the developing device 4, the toner container 5, and the intermediate hopper 6 illustrating in FIG. 11. FIGS. 13 and 14 are perspective views illustrating the intermediate hopper 6 when the developing device 4 is located at the developing position and the detachment position, respectively. Operation of the intermediate hopper 6 when the developing device 4 reciprocates between the developing position and the detachment position will be described with reference to FIGS. 4, 5, and 11 to 14.

When the developing device 4 located at the developing position illustrated in FIGS. 4 and 5 is moved to the detachment position illustrated in FIGS. 11 and 12, by moving the support frame 41 (see FIG. 7) in the direction of arrow A', the upper end portion of the third hopper portion 6*c*, which is connected to the first hopper portion 6*a*, is rotated clockwise about the pin 67*a* in FIG. 13. The lower end portion of the third hopper portion 6*c* is also rotated clockwise about the pin 67*b*. As a result, as the developing device 4 moves to the detachment position, the second hopper portion 6*b* moves in the direction of arrow N. The lower end portion of the third hopper portion 6*c* follows the movement of the second hopper portion 6*b* and also moves in the direction of arrow A'. Thus, the intermediate hopper 6 formed by the first to third hopper portions 6*a* to 6*c* connected to one another is in a bent state as illustrated in FIG. 14.

When the developing device 4 located at the detachment position illustrated in FIGS. 11 and 12, is moved to the developing position illustrated in FIGS. 4 and 5, by moving the support frame 41 (see FIG. 7) in the direction of arrow A, the upper end portion of the third hopper portion 6*c*, which is connected to the first hopper portion 6*a*, is rotated counterclockwise about the pin 67*a* in FIG. 14. The lower end portion of the third hopper portion 6*c* is also rotated counterclockwise about the pin 67*b*. As a result, as the developing device 4 moves to the developing position, the second hopper portion 6*b* moves in the direction of arrow A. The lower end portion of the third hopper portion 6*c* follows the movement of the second hopper portion 6*b* and also moves in the direction of arrow A. Thus, the first to third hopper portions 6*a* to 6*c* connected to one another are substantially on a line as illustrated in FIG. 13.

Accordingly, the developing device 4 can be selectively positioned at the developing position and the detachment position while the toner container 5 and the intermediate hopper 6 is left in the main body of image forming apparatus 100. Furthermore, since the intermediate hopper 6 is located at a position where the intermediate hopper 6 does not superpose the directions in which the toner container 5 and the developing device 4 are attached or detached (front side of the page of FIG. 5), the developing device 4 and the toner container 5 can be attached or detached without detachment of the intermediate hopper 6. That is, in order to avoid interference with the toner container 5 and the developing device 4 being attached or detached, the intermediate hopper 6 is not located in a path through which the toner container 5 and the developing device 4 is attached or detached. Accordingly, the developing device 4 and the toner container 5 can be separately attached to or detached from the image forming apparatus 100, thereby improving maintainability of the image forming apparatus 100.

When the developing device 4 is moved to the developing position or the detachment position, the positional relationship between the toner inlet port 60 of the first hopper portion 6*a* and the toner discharge port 51*a* of the toner container 5 and the positional relationship between the toner outlet port 62 of the second hopper portion 6*b* and the toner receiving port 20*a* of the developing device 4 can remain constant and unchanged. Thus, the occurrence of a defective connection between the intermediate hopper 6 and the toner container 5 and between the intermediate hopper 6 and the developing device 4 can be reliably prevented.

Since the first-third hopper portions 6*a*-6*c* are formed of stiff pipes (cylindrical bodies), the strength of the connection of the intermediate hopper 6 to the developing device 4 and connection of the intermediate hopper 6 to the toner container 5 can be improved. Furthermore, when the developing device 4 is located at the developing position, the connecting part where the first hopper portion 6*a* and the third hopper portion 6*c* are connected to each other, and the connecting part where the third hopper portion 6*c* and the second hopper portion 6*b* are connected to each other, are positioned so as to be substantially in a line as illustrated in FIG. 13. Thus, the toner supplied from the toner container 5 to the first hopper portion 6*a* through the toner inlet port 60 falls smoothly due to gravity through the third hopper portion 6*c* to the transportation portion 61*a* of the second hopper portion 6*b* and transported to the toner outlet port 62 by the spiral in the transportation portion 61*a*. Thus, an accumulation of the toner in the intermediate hopper 6 can be effectively prevented.

The present disclosure is not limited to the above-described embodiment and a variety of modifications thereof are possible without departing from the gist of the present disclosure. For example, in the above-described embodiment, the second hopper portion 6*b* has a substantially L-shape formed of the transportation portion 61*a* and the connection portion 61*b*. Instead, in the case where the toner receiving port 20*a* of the developing device 4 can be located immediately below the toner discharge port 51*a* of the toner container 5, the second hopper portion 6*b* does not need to be provided with the transportation portion 61*a*. In this case, the toner discharged through the toner discharge port 51*a* falls due to gravity through the first to third hopper portions 6*a* to 6*c* and supplied to the toner receiving port 20*a*.

In the above-described embodiment, when the developing device 4 is positioned at the developing position, the connecting part where the first hopper portion 6*a* and the third hopper portion 6*c* are connected to each other and the connecting part where the third hopper portion 6*c* and the second hopper portion 6*b* are connected to each other are positioned so as to be substantially in a line substantially perpendicular to the transportation portion 61*a*. However, the first to third hopper portions 6*a* to 6*c* may be connected to one another such that the intermediate hopper 6 is in a bent state when the developing device 4 is positioned at the developing position. In this case, in order to prevent the toner from accumulating, it is preferable that a spiral that transports the toner be also provided in each of the first hopper portion 6*a* and the third hopper portion 6*c*.

Herein, the developing device 4 as illustrated in FIGS. 2 and 3 uses a magnetic one-component developer. However, the developing device 4 is not limited to this. The developing device 4 may use a two-component developer including a toner and carrier. For example, the technology herein may be applied to a developing device that uses a magnetic roller and a developing roller and forms a thin toner layer by moving only the toner onto the developing roller while leaving the carrier on the magnetic roller. The toner container 5 is not limited to a toner container having the container case 51 in which the agitating paddle 53 and the transportation screw 52 are provided as illustrated in FIG. 5. For example, a method in which a container main body is rotated so as to move the toner in the container main body may be used.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

a main body;

a developing device located opposite an image carrying body and having a developer receiving port, an electrostatic latent image being formed on the image carrying body, the developing device including a developer carrying body that supplies a developer to the image carrying body to an area where the developer carrying body opposes the image carrying body;

a reciprocable support frame that selectively positions the developing device to a detachment position and a developing position, the developer carrying body being separated from the image carrying body at the detachment position, the developer being supplied to the image carrying body at the developing position;

a developer case located at an upper position relative to the developing device and having a developer discharge port, the developer case containing the developer to be supplied to the developing device; and an intermediate hopper located between the developer case and the developing device, wherein the intermediate hopper includes a first hopper having a developer inlet port, the developer that is discharged through the developer discharge port is received by the first hopper through the developer inlet port, the first hopper being located in the main body such that the developer inlet port opposes the developer discharge port, a second hopper having a developer outlet port, the developer being supplied to the developing device through the developer outlet port and the developer receiving port, the second hopper being located on the support frame such that the developer outlet port opposes the developer receiving port, and a third hopper having an upper end portion and a lower end portion, the upper end portion being connected to the first hopper and the lower end portion being connected to the second hopper, a part where the third hopper and the first hopper are connected to each other and a part where the third hopper and the second hopper are connected to each other being rotatable in directions that allow the support frame to move, wherein the first hopper, the second hopper, and the third hopper are each formed of a stiff cylindrical body, wherein an inner diameter of the upper end portion of the third hopper, the upper end portion being connected to the first hopper, is greater than an outer diameter of a part of the first hopper, the part of the first hopper being connected to the third hopper, and wherein an outer diameter of the lower end portion of the third hopper, the lower end portion being connected to the second hopper, is less than an inner diameter of a part of the second hopper, the part of the second hopper being connected to the third hopper.

2. The image forming apparatus according to claim 1, wherein, when the developing device is located at the developing position, the part where the third hopper and the first hopper are connected to each other and the part where the third hopper and the second hopper are connected to each other are positioned so as to be substantially in a line.

3. The image forming apparatus according to claim 2, wherein the developer supplied through the developer inlet port of the first hopper falls due to gravity through the third hopper to the second hopper.

4. An image forming apparatus comprising:

a main body;

a developing device located opposite an image carrying body and having a developer receiving port, an electrostatic latent image being formed on the image carrying body, the developing device including a developer carrying body that supplies a developer to the image carrying body to an area where the developer carrying body opposes the image carrying body;

a reciprocable support frame that selectively positions the developing device to a detachment position and a developing position, the developer carrying body being separated from the image carrying body at the detachment position, the developer being supplied to the image carrying body at the developing position;

a developer case located at an upper position relative to the developing device and having a developer discharge port, the developer case containing the developer to be supplied to the developing device; and an intermediate hopper located between the developer case and the developing device, wherein the intermediate hopper includes a first hopper having a developer inlet port, the developer that is discharged through the developer discharge port is received by the first hopper through the developer inlet port, the first hopper being located in the main body such that the developer inlet port opposes the developer discharge port, a second hopper having a developer outlet port, the developer being supplied to the developing device through the developer outlet port and the developer receiving port, the second hopper being located on the support frame such that the developer outlet port opposes the developer receiving port, and a third hopper having an upper end portion and a lower end portion, the upper end portion being connected to the first hopper and the lower end portion being connected to the second hopper, a part where the third hopper and the first hopper are connected to each other and a part where the third hopper and the second hopper are connected to each other being rotatable in directions that allow the support frame to move, wherein the first hopper, the second hopper, and the third hopper are each formed of a stiff cylindrical body, and wherein the second hopper includes a transportation portion that extends in a horizontal direction, a connection portion that upwardly protrudes substantially perpendicular to the transportation portion from the transportation portion and is connected to the lower end portion of the third hopper, and a transportation member that transports the developer is located in the transportation portion.

5. The image forming apparatus according to claim 4, wherein the transportation member includes a rotation shaft, one end of the rotation shaft extending outside of the transportation portion, and a spiral formed around the rotation shaft.

6. The image forming apparatus according to claim 1, wherein the intermediate hopper is not located in a path through which the developer case and the developing device are attached or detached.

7. An image forming apparatus comprising:

a main body;

a developing device located opposite an image carrying body and having a developer receiving port, an electrostatic latent image being formed on the image carrying body, the developing device including a developer carrying body that supplies a developer to the image carrying body to an area where the developer carrying body opposes the image carrying body;

a reciprocable support frame that selectively positions the developing device to a detachment position and a developing position, the developer carrying body being separated from the image carrying body at the detachment position, the developer being supplied to the image carrying body at the developing position;

a developer case located at an upper position relative to the developing device and having a developer discharge port, the developer case containing the developer to be supplied to the developing device; and an intermediate hopper located between the developer case and the developing device, wherein the intermediate hopper includes a first hopper having a developer inlet port, the developer that is discharged through the developer discharge port is received by the first hopper through the developer inlet port, the first hopper being located in the main body such that the developer inlet port opposes the developer discharge port, a second hopper having a developer outlet port, the developer being supplied to the developing device through the developer outlet port and the developer receiving port, the second hopper being located on the support frame such that the developer outlet port opposes the developer receiving port, and a third hopper having an upper end portion and a lower end portion, the upper end portion being connected to the first hopper and the lower end portion being connected to the second hopper, a part where the third hopper and the first hopper are connected to each other and a part where the third hopper and the second hopper are connected to each other being rotatable in directions that allow the support frame to move, and wherein the developing device is movable to the detachment position while the developer case and the intermediate hopper are left in the main body.

8. The image forming apparatus according to claim 7, wherein the developing device and the developer case are able to be attached to or detached from the main body without detachment of the intermediate hopper.

9. The image forming apparatus according to claim 4, wherein, when the developing device is located at the developing position, the part where the third hopper and the first hopper are connected to each other and the part where the third hopper and the second hopper are connected to each other are positioned so as to be substantially in a line.

10. The image forming apparatus according to claim 9, wherein the developer supplied through the developer inlet port of the first hopper falls due to gravity through the third hopper to the second hopper.

11. The image forming apparatus according to claim 4, wherein the intermediate hopper is not located in a path through which the developer case and the developing device are attached or detached.

12. The image forming apparatus according to claim 7, wherein the intermediate hopper is not located in a path through which the developer case and the developing device are attached or detached.

* * * * *